US011584551B2

(12) United States Patent
Kenn et al.

(10) Patent No.: US 11,584,551 B2
(45) Date of Patent: Feb. 21, 2023

(54) APPARATUS AND METHOD FOR PRODUCING PACKAGING

(75) Inventors: Christoph Kenn, Dueren (DE); Ralf Driessen, Moenchengladbach (DE); Thomas Vetten, Duesseldorf (DE); Michael Heil, Moenchengladbach (DE)

(73) Assignee: SIG Technology AG, Neuhausen am Rheinfall (CH)

( * ) Notice: Subject to any disclaimer, the term of this patent is extended or adjusted under 35 U.S.C. 154(b) by 704 days.

(21) Appl. No.: 13/883,869

(22) PCT Filed: Oct. 25, 2011

(86) PCT No.: PCT/EP2011/068607

§ 371 (c)(1),
(2), (4) Date: Jul. 30, 2013

(87) PCT Pub. No.: WO2012/062565

PCT Pub. Date: May 18, 2012

(65) Prior Publication Data

US 2013/0305659 A1 Nov. 21, 2013

(30) Foreign Application Priority Data

Nov. 8, 2010 (DE) ..... 102010050502.1

(51) Int. Cl.
*B31B 50/02* (2017.01)
*B31B 50/32* (2017.01)
(Continued)

(52) U.S. Cl.
CPC ..... *B65B 3/02* (2013.01); *B31B 50/84* (2017.08); *B65B 3/027* (2013.01); *B65B 7/2835* (2013.01);
(Continued)

(58) Field of Classification Search
CPC ... B65B 51/10; B31B 1/00; B31B 2201/0294; B31B 2201/2616; B31B 50/84
(Continued)

(56) References Cited

U.S. PATENT DOCUMENTS 3,120,089 A * 2/1964 Egleston ..... B29C 66/4322 53/565
4,078,364 A * 3/1978 Schmidt ..... B65B 7/18 493/184
(Continued)

FOREIGN PATENT DOCUMENTS

CN 1646302 A1 7/2005
DE 60306116 T2 3/2007
(Continued)

*Primary Examiner* — Thanh K Truong
*Assistant Examiner* — Patrick B Fry
(74) *Attorney, Agent, or Firm* — The Webb Law Firm

(57) ABSTRACT

An apparatus for producing packaging, in particular composite packaging for liquid foodstuffs, having a cross-sectional area that decreases in the pour-out direction in the gable region. The packaging is composed of a sleeve having a gable region having a plurality of gable faces and a pouring element. The apparatus has at least one rotatable mandrel wheel having a plurality of mandrels for holding the sleeves. Additionally, a method for producing such packaging and a gable press for use with the aforementioned apparatus. In order to allow easier and more cost-effective production, it is proposed that the apparatus has a gable press, assigned to a single mandrel wheel position, for folding the gable region, for connecting all the gable faces of the gable region of the sleeve to the pouring element and for sealing the protruding ears in the same mandrel wheel position.

14 Claims, 6 Drawing Sheets

(51) Int. Cl.

| | |
|---|---|
| ***B31B 50/64*** | (2017.01) |
| ***B65B 3/02*** | (2006.01) |
| ***B65B 51/10*** | (2006.01) |
| ***B65B 55/04*** | (2006.01) |
| ***B31B 50/84*** | (2017.01) |
| ***B65B 7/28*** | (2006.01) |
| ***B65B 55/10*** | (2006.01) |
| *B31B 100/00* | (2017.01) |
| *B31B 110/35* | (2017.01) |

(52) U.S. Cl.
CPC ..... *B65B 51/10* (2013.01); *B65B 55/04* (2013.01); *B65B 55/10* (2013.01); *B31B 50/024* (2017.08); *B31B 50/322* (2017.08); *B31B 50/649* (2017.08); *B31B 2100/00* (2017.08); *B31B 2100/0022* (2017.08); *B31B 2110/35* (2017.08)

(58) Field of Classification Search
USPC ..... 53/563, 565, 133.2; 493/165, 87
See application file for complete search history.

(56) References Cited

U.S. PATENT DOCUMENTS 4,386,923 A * 6/1983 Okushita ..... B65D 5/606 141/315
4,507,168 A * 3/1985 Konaka ..... B29C 65/7841 156/273.3
4,838,847 A * 6/1989 Kume ..... B65D 5/061 493/133
4,986,058 A * 1/1991 Carlsson ..... B65B 3/025 493/141
5,058,360 A * 10/1991 Yamazaki ..... B29C 65/08 53/133.2
5,088,642 A * 2/1992 Farber ..... B29C 65/02 215/232
5,120,292 A * 6/1992 Ueda ..... B31B 50/00 493/124
5,222,667 A * 6/1993 Fujikawa ..... B65D 5/06 229/104
5,829,228 A 11/1998 Mogard
5,867,966 A * 2/1999 Mogard ..... B65D 5/746 493/105
5,943,840 A * 8/1999 Nilsson ..... B31B 1/00 493/105
6,149,566 A * 11/2000 Nishio ..... B29B 13/025 493/133
6,321,813 B1 * 11/2001 Miyajima ..... B29C 65/02 156/497
7,090,630 B2 * 8/2006 Boldrini ..... B31B 1/00 493/175
7,390,290 B2 6/2008 Gustafsson et al.
7,736,288 B2 * 6/2010 Mizuo ..... B29C 65/02 493/213
7,828,198 B2 * 11/2010 Boldrini ..... C08F 2/52 222/566
2005/0127118 A1 * 6/2005 Boldrini ..... B65D 5/746 222/556
2009/0098989 A1 * 4/2009 Boldrini ..... B31B 1/00 493/87

FOREIGN PATENT DOCUMENTS

| | | | |
|---|---|---|---|
| EP | 1616800 | A2 | 1/2006 |
| EP | 1503940 | B1 | 9/2009 |
| WO | 9908939 | A1 | 2/1999 |
| WO | 0020194 | A1 | 4/2000 |
| WO | 2004011238 | A2 | 2/2004 |
| WO | 2005113222 | A1 | 12/2005 |

* cited by examiner

APPARATUS AND METHOD FOR PRODUCING PACKAGING

BACKGROUND OF THE INVENTION

Field of the Invention

The invention relates to an apparatus for producing packaging, in particular composite packaging for liquid foodstuffs, having a cross-sectional area that decreases in the pour-out direction in the gable region, composed of a sleeve having a gable region having a plurality of gable faces and of a pouring element, wherein the apparatus has at least one rotatable mandrel wheel having a plurality of mandrels for holding the sleeves, as well as a method for producing such packaging, comprising the steps of:

a) Pushing a pouring element onto a mandrel of the mandrel wheel,
b) Pushing a sleeve onto a mandrel of the mandrel wheel,
c) Folding and connecting all gable faces of the gable region of the sleeve to the pouring element,
d) Sealing the protruding ears,
e) Turning down and tacking the ears,
f) Removing the packaging from the mandrel.

In addition the invention relates to a gable press for use with the abovementioned apparatus.

Description of Prior Art

Apparatuses and methods for producing composite packaging are known from practice in numerous variants. Composite packaging is understood to mean packaging made of packaging material, which consists of a plurality of materials which are bonded together over the entire surface, for instance cardboard and plastic. The liquid foodstuffs may concern for example beverages, soups, yoghurt or such like. Many known apparatuses and methods are designed for producing packaging which is block-shaped.

However it may be necessary for aesthetic and functional reasons to produce packaging which does not have a constant cross-sectional area along its total height. In particular it may be desirable to produce packaging which in the upper region of the packaging has a cross-sectional area that decreases in the pour-out direction and therefore is not block-shaped. In the first instance this allows for an appealing form of the packaging, since the transition of the large cross-sectional area of the sleeve to the smaller cross-sectional area of the pouring element can be symmetrical. In addition the symmetrical decrease of the cross-sectional area has the technical effect that liquid contents can flow particularly easily from the packaging. In particular due to such a form of the packaging it is rendered possible that the packaging can be completely emptied, without having to hold it from below absolutely vertically to the pouring element. The upper region of the packaging in this respect can take over the function of a funnel. The form described of the upper region of the packaging is also designated gable form.

The production of packaging with cross-sectional area that decreases in the pour-out direction in the gable region however makes special demands on the machines, with which the packaging is produced. Moreover the process steps have to be adapted in comparison to methods for producing block-shaped packaging. In particular it must be considered that when folding the gable region of packaging with cross-sectional area that decreases in the pour-out direction, surplus packaging material forms folds, which are also known as ears.

A container for a liquid product and a method for producing and filling the container are known from EP 1 503 940 B1. The container has a truncated pyramid shape in its upper region. This shape is supported by a correspondingly formed pouring element, which is inserted into the upper region of the packaging. The packaging is produced, as often, using a rotatable mandrel wheel and is illustrated by way of FIGS. 10-15 in EP 1 503 940 B1. The apparatus illustrated and the method described have the disadvantage that folding and sealing the gable region of the packaging require separate production processes in separate positions of the mandrel wheel. The consequence of this is that production is complex and inefficient.

WO 2005/113222 A1 discloses a further apparatus and a method for producing packaging. The packaging indicated here has a cross-sectional area that decreases in the pour-out direction in its upper region. For producing the packaging again a rotary mandrel wheel is used. However it is also disadvantageous with this apparatus and this method that in a mandrel wheel position only two opposite-lying gable faces can be connected to the pouring element in each case. In the case of packaging with a square sleeve cross-sectional area two mandrel wheel positions must therefore be used in order to fold the four gable faces and to seal them with the pouring element. This results in an increase in the number of production processes and thus a decrease in the efficiency of processing.

SUMMARY OF THE INVENTION

The object of the invention is to configure and refine the apparatus initially mentioned and described above in detail and the corresponding method, in such a way that simpler and thus more economical production is rendered possible.

This object is achieved with an apparatus that having a gable press assigned to a single mandrel wheel position for folding the gable region, for connecting all gable faces of the gable region of the sleeve to the pouring element and for sealing the protruding ears in the same mandrel wheel position.

By connecting the gable faces to the pouring element as well as by sealing the ears in the same mandrel wheel position, the number of mandrels can reduced and if necessary a smaller mandrel wheel can be used. Alternatively other production processes can be assigned to the freed-up mandrels. In addition the energy required for making the connection can be efficiently used. The connections between the gable faces and the pouring element are made in particular by heating and pressing. Alternatively or additionally welding and/or bonding methods may be employed. The connections made are preferably gas- and/or water-tight, for which reason sealing is also referred to. The cross-sectional area of the packaging should decrease in particular in the pour-out direction in the gable region of the packaging. The pour-out direction is understood to mean any direction, which points from the base region of the packaging to the pour-out opening. If the cross-sectional area of the sleeve is square, the gable region can have the form of a pyramid or a truncated pyramid. If the cross-sectional area of the sleeve is triangular, the gable region can have the form of a tetrahedron or a truncated tetrahedron accordingly.

The same is valid for sleeve cross-sectional areas with five or more corners. A gable region with a round cross-sectional area of the sleeve, which has the form of a cone or a truncated cone, is equally conceivable. Preferably the pouring element, in any case in its regions assigned to the gable faces, also has a corresponding form. Also the points of the mandrels can be formed according to the gable form to be produced. Due to the decrease of the cross-sectional area, surplus packaging material when the gable region is created forms protruding folds, which are also known as ears. Sealing the ears is understood to mean sealing the packaging in the region of the ears. This is distinct from turning down and tacking the ears.

According to a further embodiment of the invention, the apparatus has an ear press for turning down and tacking the ears. The ear press can preferably turn down all ears, resulting when the gable region was formed, in the same mandrel wheel position and tack them to the adjacent gable faces. In addition separate tools can be provided for turning down and tacking each ear. The ears can be sealed by heating and pressing. Alternatively or additionally welding and/or bonding methods may be employed.

In a further embodiment of the invention it may be proposed that the apparatus has a pusher for moving the sleeve on a mandrel from an intermediate position into a final position. The pusher allows the sleeves to be moved between two axially spaced positions on the mandrel. The intermediate position represents a position, in which the sleeve has not yet completely moved onto the mandrel and is therefore axially further outside than in the final position. Preferably the gable region of the sleeve is in the intermediate position away over the end of the mandrel and is therefore particularly easily accessible. This can be advantageous in the event of pre-treatment, for instance by heating.

In order to improve sealing of the packaging, the apparatus can have at least one heating device for heating the gable region of the sleeve. The pre-treatment of the sleeves by heating is also known as activating and improves the quality of the connection to be made. For example a plastic contained in the packaging material can be plasticised by heating. Preferably the heating device divides the air flow and conducts the hot air through nozzles both onto the insides of the gable region of the sleeve and onto the pouring element. The heating device can move into and out of the gable region of the sleeve towards the mandrel. By providing a plurality of heating devices, particularly intensive pre-treatment of the sleeves is possible, without having to reduce the cycle time of the mandrel wheel. In addition a particularly variable pre-treatment of the sleeves is possible with two heating devices, since the second heating device can be switched on as required.

Preferably in accordance with a further embodiment of the invention the pusher can be arranged in the rotation direction of the mandrel wheel after the heating device and before the gable press. This arrangement means that the sleeves, during the operation of the heating device, are located in the intermediate position and are only moved subsequently by the pusher into the final position. Only in this way can the heating device reach and heat the required regions of the sleeve and the pouring element.

Controlled heating of the ears may be achieved by providing the apparatus with heating devices for heating the ears. The heating device for heating the ears can be exactly synchronised with the number and form of the ears. This allows for economical use of energy for heating. Preferably all ears of the packaging are heated in the same mandrel wheel position by the heating device. In addition separate hot-air nozzles can be provided for each ear.

A compact form can be achieved in a further embodiment of the invention, if the gable press and the ear press are assigned to the same mandrel wheel position. The number of mandrels can be further reduced in this way. Alternatively other production processes can be carried out on the freed-up mandrels. In addition the energy required can be concentrated locally in use. According to a further teaching of the invention, it is proposed that the apparatus has a rinsing system for aseptic rinsing of the packaging. The rinsing system guarantees that the packaging, before filling with contents, is generally bacteria-free. The rinsing system can be arranged downstream of the mandrel wheel as part of a filling station.

In a further arrangement it is proposed that the apparatus has a filling device for filling the packaging through the open base region and/or through the open pouring element. The packaging which is only closed on one side is filled with contents by the filling device. The filling device can also be arranged downstream to the mandrel wheel as part of a filling station.

Finally it may be proposed that the apparatus has a closing device for closing the base region. The base region of the packaging is closed by the closing device, as a result of which packs, that is to say filled packaging, are produced. The closing device likewise can be arranged downstream to the mandrel wheel as part of a filling station. Alternatively the base region can also be closed by the closing device even before the packaging is filled with contents. In this case the packaging closed on both sides can be filled through the opened pouring element.

In respect to the method initially mentioned and described in detail above the underlying object is achieved by a method with the features of the preamble of claim 11 in that steps c) and d) are carried out in the same mandrel wheel position.

By carrying out steps c) and d) combined in the same mandrel wheel position, the number of separate, that is to say spatially divided, production processes can be reduced or other production processes can be assigned to the freed-up mandrel wheel position. Furthermore the energy required for connecting and sealing, for instance heat, can be concentrated locally in use and thus efficiently, if steps c) and d) are carried out in same position. Preferably in step e) all ears are turned down and tacked in the same mandrel wheel position.

A further embodiment of the invention proposes that, apart from steps c) and d), also step e) can be carried out in the same mandrel wheel position.

In accordance with a further teaching of the invention, it may be proposed that in step a) a pouring element is pushed onto an empty mandrel of the mandrel wheel, before step b) is carried out. By firstly pushing the pouring elements onto the mandrel and then pushing the sleeves away over the pouring elements onto the mandrel, production can proceed more quickly and simply in comparison to exactly-targeted insertion of the pouring elements into the not very dimensionally stable sleeves.

In a further embodiment of the invention, it is proposed that the sleeve in the gable region is folded and/or bent for the first time in step c). Folding of the sleeves when the gable faces of the gable region of the sleeve are being connected to the pouring element has the advantage that a separate process step, in which the gable faces are folded or pre-folded, can be dispensed with. The sleeves must only be folded before being pushing onto the mandrel from a flat form into a tubular form; however folding on the mandrel wheel is not done before step c).

Sealing of the packaging is particularly reliable, if step b) in accordance with a further embodiment of the invention comprises three sub-steps: ba) pushing a sleeve onto a mandrel of the mandrel wheel into an intermediate position, bb) heating the gable region of the sleeve, bc) further pushing the sleeve onto the mandrel into a final position. This sequence of steps has the advantage that the gable region in the first instance extends beyond the end of the mandrel and is therefore particularly very accessible for heating. Also the pouring element can be heated more easily.

Heating in accordance with a further embodiment of the invention can be rendered particularly effective by carrying out step bb) in two mandrel wheel positions. Preferably these are consecutive mandrel wheel positions. Because heating of the gable region of the sleeve is shared between two mandrel wheel positions, the gable faces of the sleeves can be heated particularly intensively without having to rotate the mandrel wheel more slowly. A longer heating period is thus achieved with constantly high cycle time of the mandrel wheel. Also the variability of heating is increased, since heating can be done in the second mandrel wheel position as required.

The ears adhere particularly well to the gable faces, if in accordance with a further teaching of the invention, the ears are heated before step e). It is guaranteed by additional heating of the ears that adhesion of the ears to the gable faces remains particularly firm in the subsequent turning down and tacking operations. Preferably all ears are heated in the same mandrel wheel position.

The efficiency of the method can be increased, in a further embodiment of the invention, by carrying out heating of the ears before step d) and after steps d) and e) in the same mandrel wheel position. Combination of production processes d) and e) in the same position of the mandrel wheel allows the number of separate production processes to be reduced. Likewise it is possible to carry out other production processes in the freed-up mandrel wheel positions. In addition the energy required, for instance heat, can be concentrated locally and therefore used efficiently.

Hygiene during production can be guaranteed in a further embodiment of the invention, as it is proposed that after step f) the packaging is aseptically rinsed from the inside. It is ensured by aseptic rinsing that the packaging is bacteria-free.

Finally it is proposed in a further embodiment of the invention that after step f) firstly the packaging is filled through the open base region and afterwards the base region is closed. Likewise the teaching of the invention recognised that alternatively after step f) firstly the base region is closed and then the packaging is filled through the open pouring element. Filling through the open base has the advantage of a larger cross-sectional area, through which contents are filled. On the other hand filling at the bottom of the closed packaging through the pouring element has the hygienic advantage that production and filling of the packaging can be spatially separated.

The underlying object may also be achieved by each of the pressing tools having one gable pressing face and two ear pressing faces. The gable pressing face is assigned to a gable face and each of the two ear pressing faces is assigned to one of the ears adjacent to this gable face. The gable press preferably has a separate pressing tool for each of the gable faces, so that all gable faces and ears can be sealed in a single production process. Preferably for this purpose two adjacent pressing tools correspond with one another in respect to their ear pressing faces in each case. A particularly expedient embodiment is achieved, if in the case of at least two pressing tools the ear pressing faces run in the plane of the gable pressing faces.

DETAILED DESCRIPTION OF THE INVENTION

Figure 1:
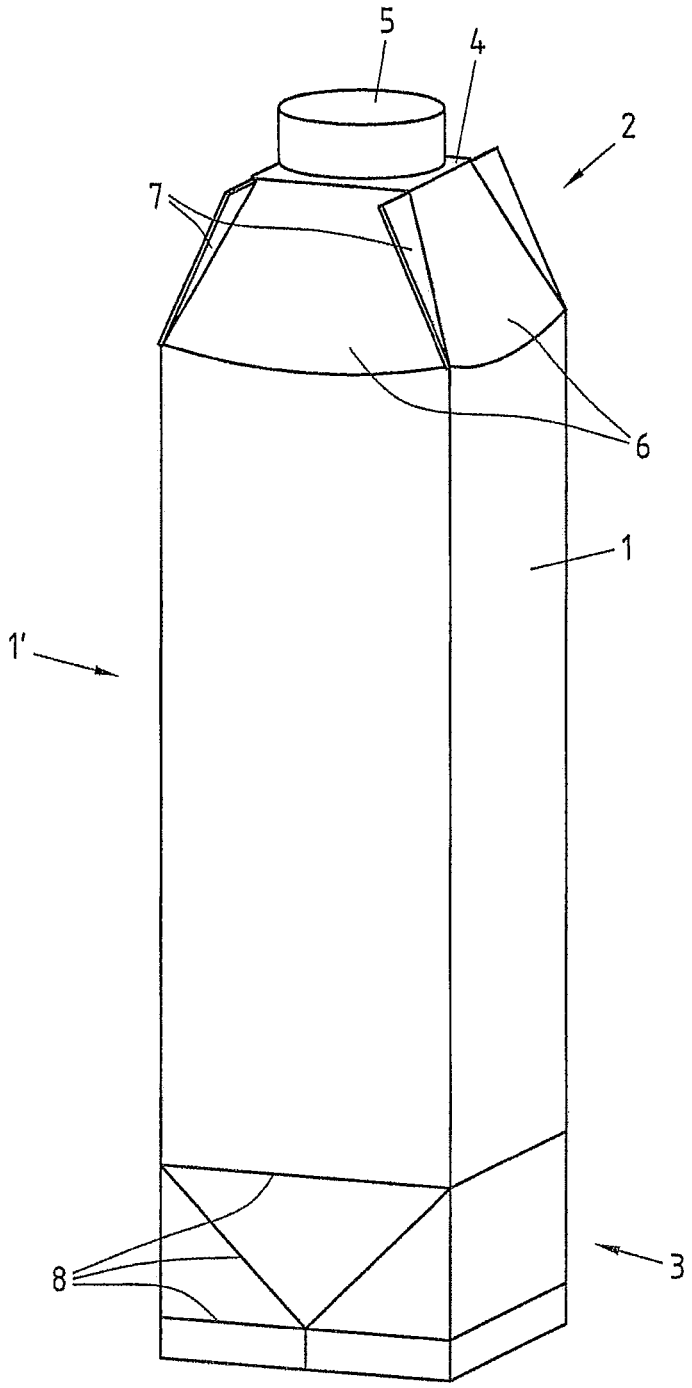
FIG. 1 is a perspective view of packaging, closed in the gable region, with protruding ears.

FIG. 1 illustrates packaging 1' closed on one side, made of a sleeve 1. The sleeve 1 has a gable region 2 and a base region 3 at its two ends. The packaging 1' has a square cross-sectional area. The sleeve 1 is regularly folded from a blank, two edges being connected together to create a tubular form. The gable region 2 was already closed, while the base region 3 is still open. The packaging 1' shown in FIG. 1 therefore represents an interim stage of a production process, in the course of which firstly packaging 1' and later a filled and closed—ready for sale—pack is produced from a sleeve 1 open on both sides.

In the gable region 2 the sleeve 1 is connected to a pouring element 4, which has a screw cap 5. The gable region 2 in the exemplary embodiment shown in FIG. 1 is created in the form of a truncated pyramid. The consequence of this is that the packaging 1' in the gable region 2, apart from four gable faces 6, also has four ears 7 protruding from the gable region 2 formed by surplus packaging material. Although the ears 7 in the situation shown in FIG. 1 are sealed, they are neither turned down nor tacked to the gable faces 6. In the base region 3 the packaging
1' is still not closed and is only folded and closed in a later production step along folding lines 8.

Figure 2:
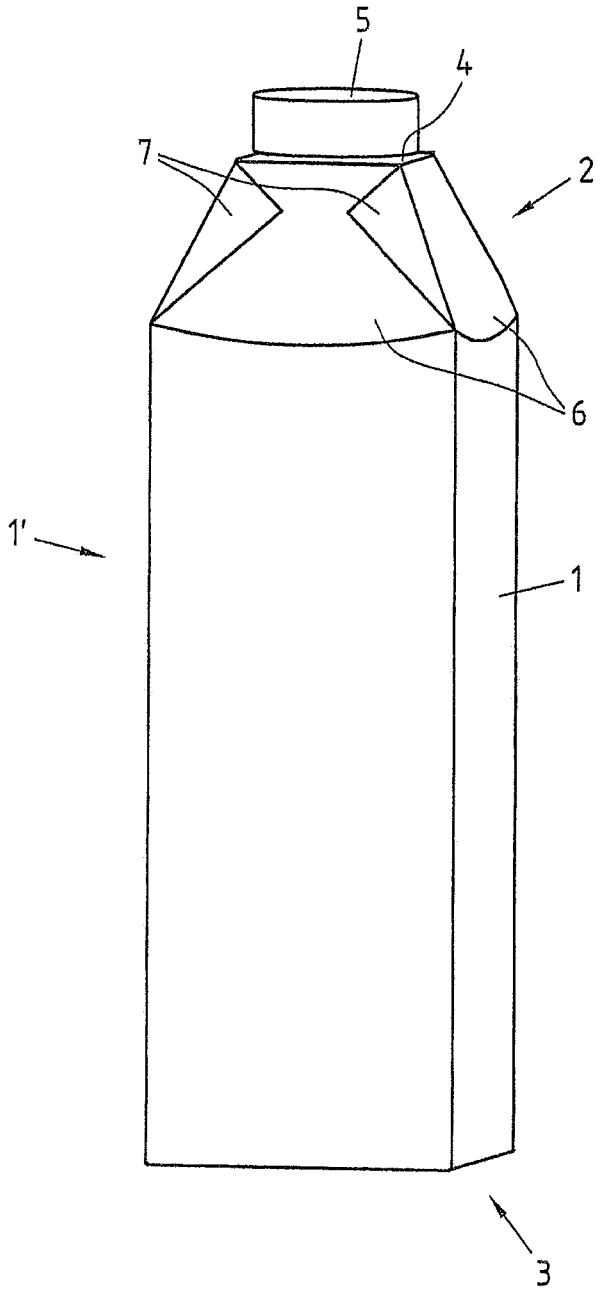
FIG. 2 is a perspective view of packaging, closed in the gable region and in the base region with flush ears.

A packaging 1' closed both in the gable region 2 and in the base region 3 is shown in FIG. 2. In the case of the sleeve 1 illustrated in FIG. 2 the production process is completed so far that packaging 1' is already referred to. The packaging 1' is closed and sealed in the base region 3. In addition the ears 7 are turned down and tacked to one of the two gable faces 6 adjacent to the respective ear 7. In the flush—and shown in FIG. 2—state of the ears 7, the embodiment of the gable region 2 as truncated pyramid is particularly easy to see. The bottom face of the truncated pyramid in this case corresponds approximately to the cross-sectional area of the packaging 1'. The four lateral sides of the truncated pyramid here are called gable faces 6. The upper face of the truncated pyramid is substantially parallel to the bottom face and is normally designated top face. The top face in the case of the packaging shown in FIG. 2 is formed by the pouring element 4.

Figure 3:
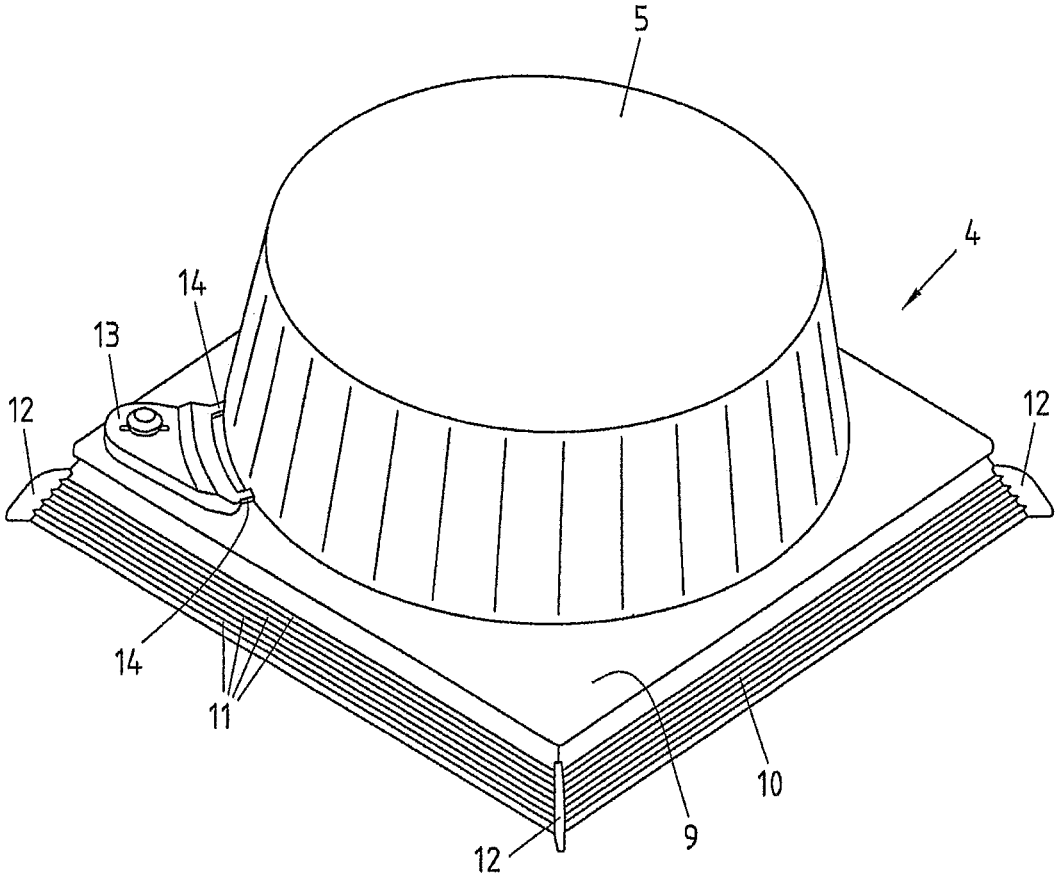
FIG. 3 is a perspective view of a pouring element.

FIG. 3 shows the pouring element 4 from FIG. 1 and FIG. 2 in perspective view. The pouring element 4 as well as the screw cap 5 has a square base plate 9 with a flange 10 circulating and angled in respect to the base plate 9. The shape of the flange 10 is preferably adapted to the form and in particular to the angle of inclination of the gable region 2. The angled flange 10 has ribs 11, which on the one hand are designed to mechanically reinforce the flange 10 and on the other hand to enable the gable faces 6 to be better joined to the flange 10. A wing 12 is moulded onto the flange 10 in each corner region. The wings 12 also serve to improve the join between the gable region 2 of the sleeve 1 and the flange 10 of the pouring element. In the case of the pouring element 4 shown in FIG. 3 a tamper-proof seal 13 with material bridges 14 formed as pre-determined breaking points connects the base plate 9 to the screw cap 5. When first opened the material bridges 14 are destroyed, so that a user can easily detect whether a packaging provided with this pouring element has already been opened previously.

Figure 4:
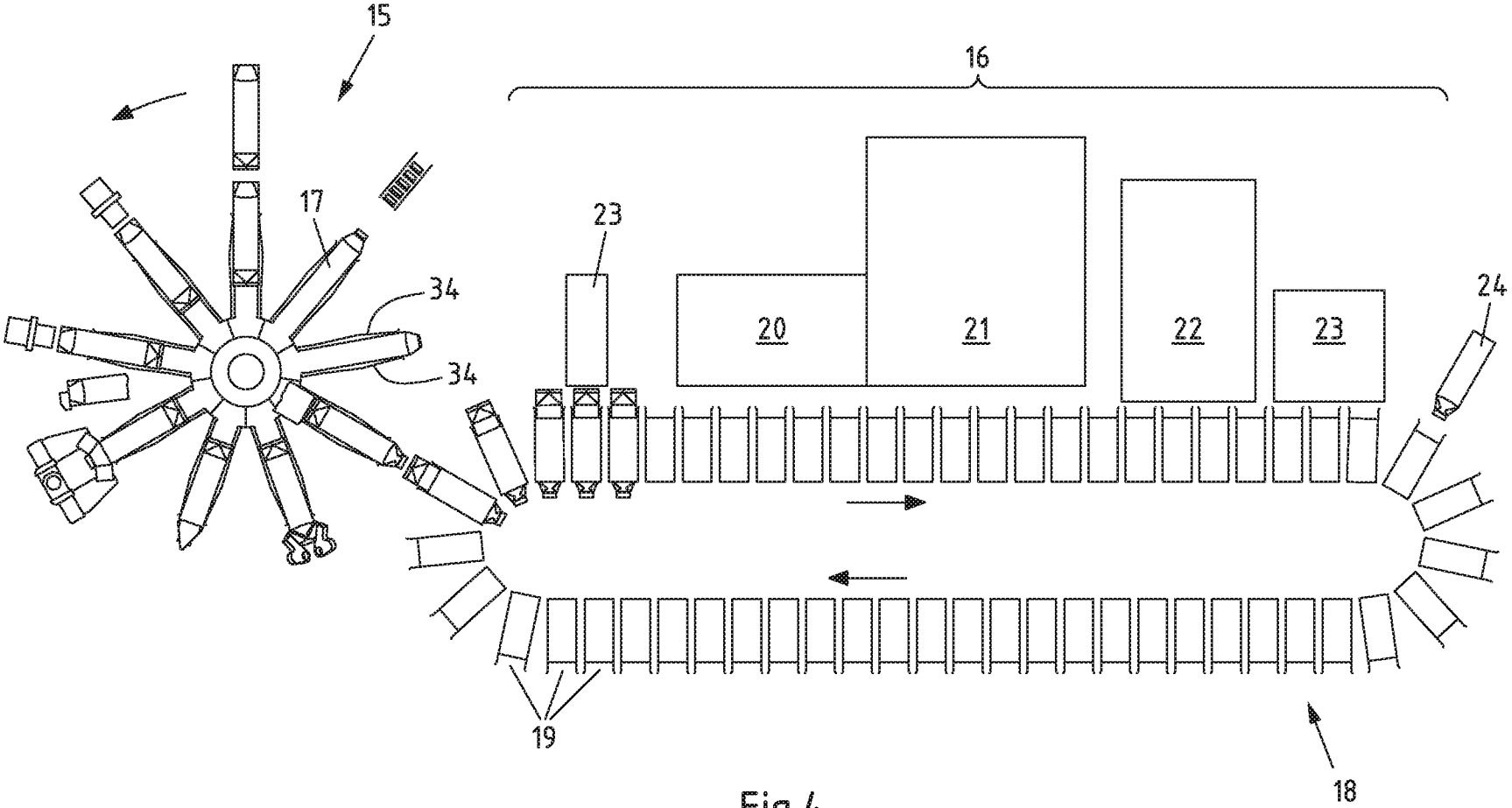
FIG. 4 shows an apparatus for producing packaging in overall illustration.

In FIG. 4 an apparatus for producing packaging is shown in overall illustration. The apparatus has a mandrel wheel 15 and a filling station 16. The mandrel wheel 15 shown in FIG. 4 has nine mandrels 17 and during operation rotates cyclically, that is to say step-by-step in the anti-clockwise direction. The construction and mode of operation of the mandrel wheel 15 is discussed more precisely in connection with FIG. 5. The filling station 16 has a conveyer system 18 with cells 19, which moves in the clockwise direction. The type of the conveyer system 18 is frequently designated as cell chain.

The packagings 1' finally closed in the gable region 2, after the production processes on the mandrel wheel 15 have been completed, are passed to cells of the conveyer system 18. In this case the packagings 1' with the gable region 2 are advanced into the cells 19, so that the opened base region 3 points outwards. The filling station 16 has a rinsing system 20, a filling device 21 and a closing device 22. In addition the filling station 16 comprises monitoring units 23. Initially the packaging 1' open in the base region 3 is conveyed past the first monitoring unit 23, wherein the correct position of the packagings 1' in the cells 19 of the conveyer system 18 is checked. This can be done for instance by optical sensors. Subsequently the packagings 1' are aseptically rinsed in the vicinity of the rinsing system 20, in order to ensure the inside of the packagings 1' is bacteria-free for the following filling. Then the packagings 1' closed in the gable region 2 are filled with contents in the vicinity of the filling device 21 through the open base region 3. As next step the base region 3 of the packagings 1' is closed and sealed in the vicinity of the closing device 22. The filled and closed packagings 1' are also designated as packs 24 and conveyed through the second monitoring unit 23, wherein the base region 3 of the packs 24 is checked. Also this can be done by optical sensors. Finally the packs 24 are removed from the cells 19 in the right end section of the conveyer system 18, before the emptied cells 19 are returned towards the mandrel wheel 15.

Figure 5:
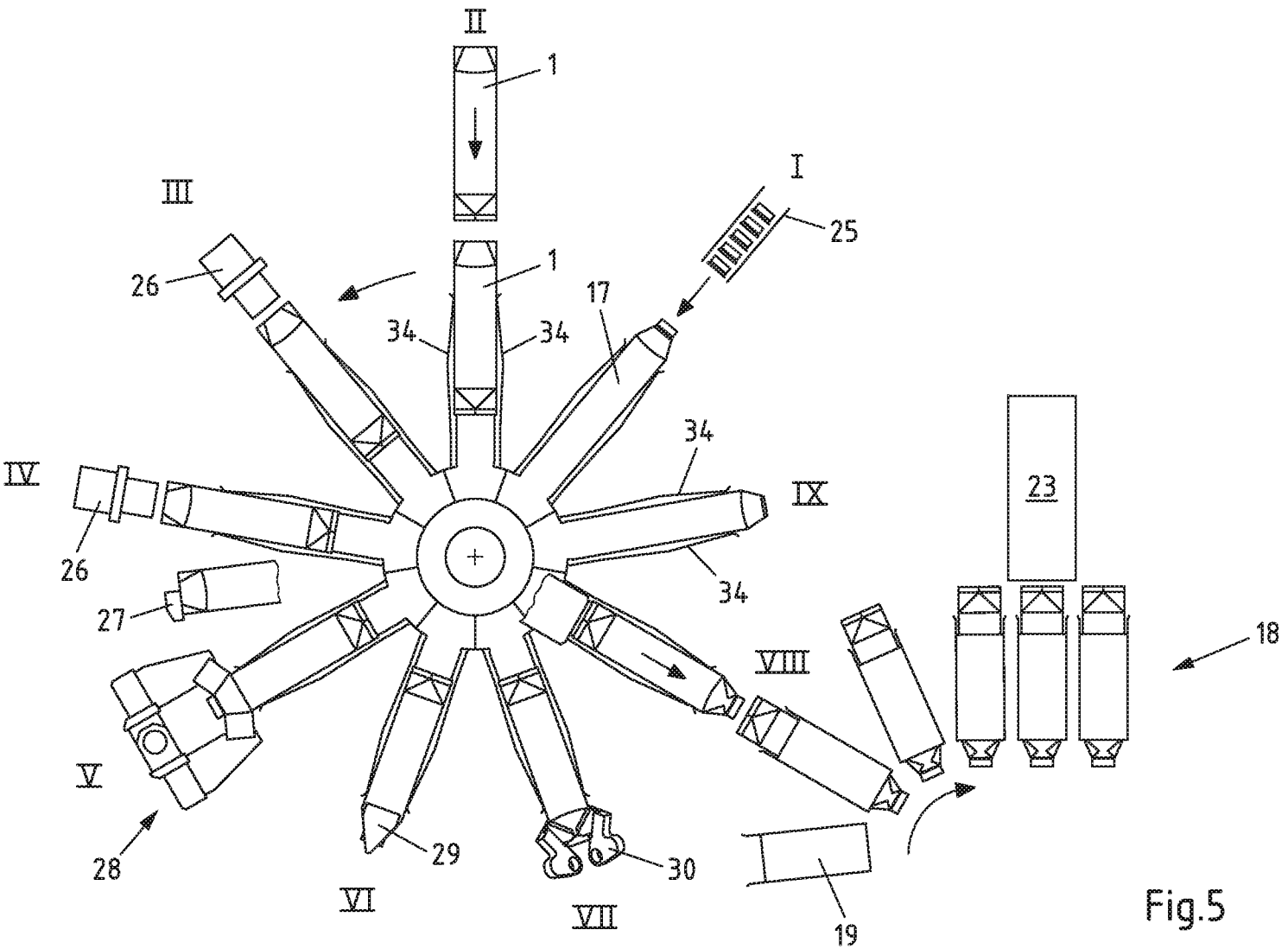
FIG. 5 shows the mandrel wheel of the apparatus illustrated in FIG. 4 for producing packaging in magnified view.

FIG. 5 shows the mandrel wheel 15 from FIG. 4 in magnified view. In addition part of the conveyer system 18 is visible in the lower right section of FIG. 5. The mandrel wheel 15 has nine mandrels 17 in the illustrated and to this extent preferred exemplary embodiment, which are arranged at the same 40° angle along the periphery of the mandrel wheel 15. A full rotation of the mandrel wheel 15 can be notionally and spatially divided into nine sectors, which are here called mandrel wheel positions and in FIG. 5 are designated with Roman numerals I to IX. The mandrel wheel 15 can therefore pass through nine separate production processes before a full rotation is completed and each of the mandrels 17 is again returned to its original mandrel wheel position.

In mandrel wheel position I the pouring element 4 is pushed onto the empty mandrel 17 and the mandrel wheel 15 rotates further by one mandrel wheel position. For the provision and supply of pouring elements 4 a feed arrangement 25 only roughly indicated in FIG. 5 can be provided. In mandrel wheel position II a sleeve 1 is pushed onto the mandrel 17 away over the pouring element 4 previously pushed and held on the mandrel 17. Preferably, even if not mandatory, the sleeve 1 is not pushed in this case as far as a stop into a final position, but for the time being remains in an intermediate position on the mandrel 17. The intermediate position can be 20 mm-40 mm in front of the final position. In this case spring clips 34 secure the axial position of the sleeves 1 on the mandrel 17. Subsequently, the mandrel wheel 15 rotates further into mandrel wheel position III.

In mandrel wheel position III the gable region 2 of the sleeve 1 as well as the pouring element 4 is activated with hot-air. For this purpose a heating device 26 is provided in the vicinity of mandrel wheel position III. The heating device 26 should heat in particular the inside of the sleeve 1 in the vicinity of the gable region 2 and the exteriors of the flanges 10 of the pouring element 4, since these regions are assigned to each other and are intended to form a connection. Heating in this context is also known as activating. In the embodiment shown in FIG. 5 and to this extent preferred embodiment, in mandrel wheel position IV, the same production process is carried out as in mandrel wheel position III. Therefore the apparatus likewise has a heating device 26 in the vicinity of mandrel wheel position IV.

A pusher 27, which pushes the sleeves 1 pushed onto the mandrels 17 from the intermediate position into the final position, is provided between mandrel wheel positions IV and V. The production step implemented by the pusher 27 must not necessarily be carried out between two mandrel wheel positions, but can also be carried out in any one of the mandrel wheel positions. After the mandrel wheel 15 rotated further, the gable region 2 is treated by a gable press 28 in mandrel wheel position V. The gable press 28 presses the gable faces 6 onto the flange 10 of the pouring element 4 and in this way makes a sealed connection. This can be done by the aforementioned heating and pressing, alternatively—without previous activation—also by welding and bonding methods. In the same way the gable region 2 of the sleeve 1 is sealed by the gable press 28 also in the vicinity of the ears 7. The ears 7 in the case of the mandrel wheel 15 shown in FIG. 5 however are not already rendered flush against the gable faces 6 by the gable press 28 in mandrel wheel position V. After the sleeve 1 in the gable region 2 is sealed with the pouring element 4, it forms a packaging 1' closed on one side.

After a further rotation of the mandrel wheel 15 the gable region 2 is treated with a heating device 29 in mandrel wheel position VI. The heating device 29 serves in particular to heat and thus activate the protruding ears 7 and is therefore formed differently than the heating devices 26 from mandrel wheel positions III and IV. Preferably the heating device 29 is particularly synchronised with the number and form of the ears 7. After further rotation of the mandrel wheel 15 the protruding ears 7 are turned down by an ear press 30 and tacked to the gable faces 6 in mandrel wheel position VII. This can be done in particular by heating and pressing. Alternatively welding or bonding methods are also conceivable. In mandrel wheel position VIII packagings 1 are drawn by the mandrel 17 and picked up by a cell 19 of the conveyer system 18. In this case packagings 1' are not turned, so that they are conveyed the other way round, that is to say with open base region 3 pointing upwards. No production process is assigned to mandrel wheel position IX.

Figure 6:
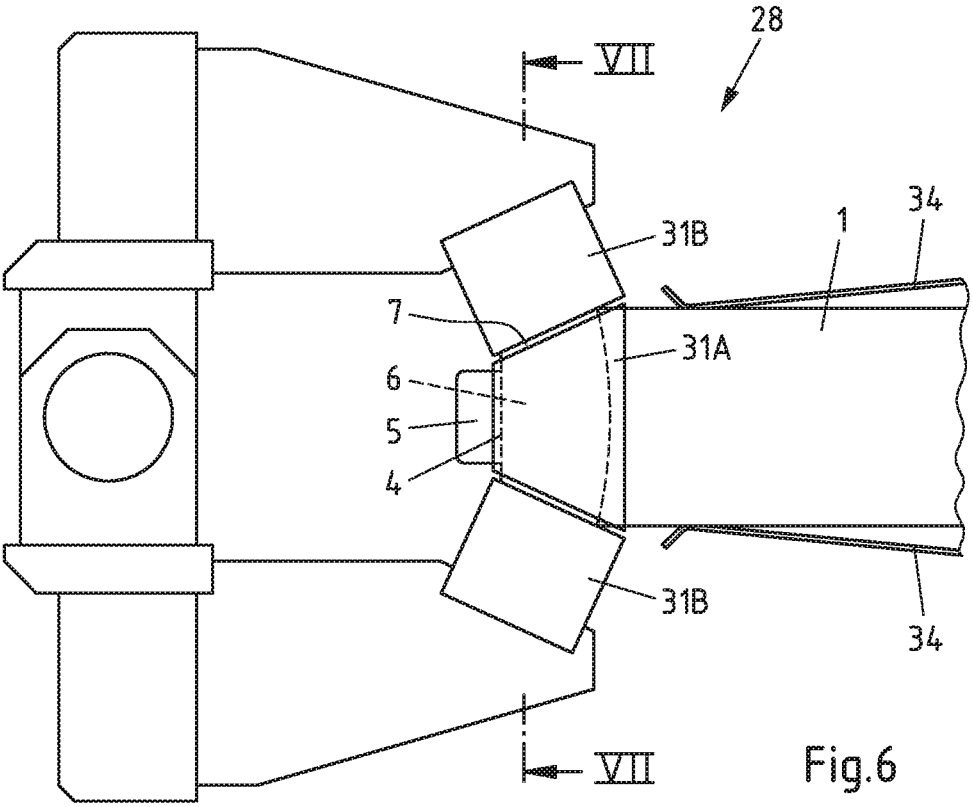
FIG. 6 shows the gable press of the apparatus illustrated in FIG. 5 for producing packaging in once again magnified view and FIG. 7 shows the gable press in sectional view along line VII-VII from FIG. 6.
Figure 7:
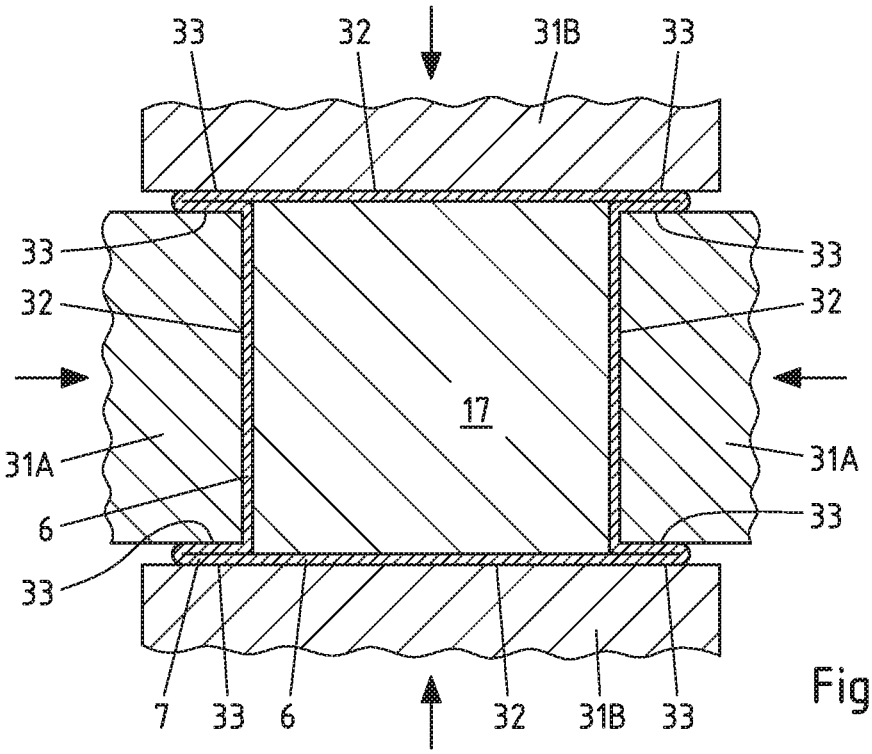

The gable press 28 assigned to mandrel wheel position V is shown in FIG. 6 once again in magnified view. A sectional view of the gable press 28 along line VII-VII of FIG. 6 is illustrated in FIG. 7. Firstly a sleeve 1 pushed onto a mandrel wheel 15—not shown in FIG. 6—is visible in FIG. 6. The gable faces 6 of the sleeve 1 should be joined by the gable press 28 to the pouring element 4. For this purpose the gable press 28 has four pressing tools 31A, 31B corresponding to the number of gable faces 6, of which for reasons of clarity only two opposite-lying pressing tools 31B and one of the two pressing tools 31A are shown in FIG. 6.

In the case of a packaging with square cross-sectional area the gable press 28 thus has four pressing tools 31A, 31B. Each of the pressing tools 31A, 31B has a gable pressing face 32 and two ear pressing faces 33, as shown in FIG. 7. In the case of the two opposite-lying pressing tools 31A the ear pressing faces 33 are angled in respect to the gable pressing face 32. In the case of the other two opposite-lying pressing tools 31B the ear pressing faces 33 lie in a plane with the gable pressing face 32. The gable pressing faces 32 in each case press a gable region 6 against the pouring element 4. For compressing and sealing the ears 7 two adjacent pressing tools 31A, 31B must interact with their ear pressing faces 33 assigned to each other. This can be done for example in the case of a packaging with square cross-sectional area, by firstly moving the two opposite-lying pressing tools 31A towards the mandrel. In this case two opposite-lying gable faces 6 are pressed against the pouring element 4. The ears 7 of these two gable faces 6 are firstly only supported on one side by the ear pressing faces 33 of the two already relocated pressing tools 31A.

Then the two remaining pressing tools 31B, which for their part likewise face each other, are actuated. Again in this case two opposite-lying gable faces 6 are pressed by the gable pressing faces 32 against the pouring element 4. At the same time the four ears 7 are compressed and sealed by two ear pressing faces 33 in each case. Alternatively it is also possible that all pressing tools 31A, 31B are actuated at the same time. The movement directions of the pressing tools 31A, 31B are shown by arrows in FIG. 7.

The invention claimed is:

1. An apparatus for producing packaging, with a cross-sectional area that decreases in a pour-out direction in a gable region, the packaging comprising:

a sleeve having the gable region having a plurality of gable faces and a pouring element having a flange in the form of a truncated pyramid, wherein the apparatus comprises at least one rotatable mandrel wheel having a plurality of mandrels for holding the sleeve, a gable press assigned to a single mandrel wheel position for folding the gable region, for connecting all of the gable faces of the gable region of the sleeve to the pouring element, an ear press assigned to a single mandrel wheel position for sealing ears protruding from the gable region in the same mandrel wheel position, and at least one heating device for heating the ears of the sleeve, wherein the at least one heating device is assigned to a single mandrel wheel position subsequent to the gable press, wherein the ears are bent and sealed to a straight section of the gable region, and wherein a pusher for pushing the sleeve on one of the plurality of mandrels from an intermediate position into a final position is arranged in the rotation direction of the mandrel wheel after two additional heating devices, both being used to heat an inside of the sleeve in a vicinity of the gable region and exteriors of the flanges of the pouring element, and before the gable press, wherein the heating device used for heating the ears of the sleeve and the two additional heating devices used to heat the sleeve and the pouring element are provided separate from one another.

2. The apparatus for producing packaging according to claim 1, wherein the ear press is used for turning down and tacking the ears.

3. The apparatus for producing packaging according to claim 1, wherein the apparatus has a rinsing system for aseptic rinsing of the packaging.

4. The apparatus for producing packaging according to claim 1, wherein the apparatus has a filling device for filling the packaging through an open base region, through the open pouring element or both.

5. The apparatus for producing packaging according to claim 1, wherein the apparatus has a closing device for closing a base region of the packaging.

6. A method for producing packaging having a cross-sectional area that decreases in the pour-out direction, the packaging comprising a sleeve having a gable region having a plurality of gable faces and a pouring element having a flange in the form of a truncated pyramid, on a rotatable mandrel wheel having a plurality of mandrels for holding the sleeve, comprising the steps of:

a) Pushing a pouring element onto a mandrel of the mandrel wheel, b) Pushing a sleeve onto a mandrel of the mandrel wheel, c) Folding and connecting all the gable faces of the gable region of the sleeve to the pouring element, d) Sealing ears protruding from the gable region, e) Turning down and tacking the ears to a straight section of the gable region, and f) Removing the packaging from the mandrel, wherein steps c) and d) are carried out in the same mandrel wheel position, wherein, after step d) and before step e), one additional heating device heats the ears and the pouring element, and wherein step b) comprises three sub-steps:

i) pushing a sleeve onto a mandrel of the mandrel wheel into an intermediate position, ii) heating the gable region of the sleeve and the pouring element using at least two separate heating devices, both being used to heat an inside of the sleeve in a vicinity of the gable region and exteriors of the flanges of the pouring element, iii) further pushing the sleeve on one of the plurality of mandrels into a final position, wherein the heating device used for heating the ears of the sleeve and the two additional heating devices used to heat the sleeve and the pouring element are provided separate from one another.

7. The method for producing packaging according to claim 6, wherein in step a) the pouring element is pushed onto an empty mandrel of the mandrel wheel before step b) is carried out.

8. The method for producing packaging according to claim 6, wherein the sleeve in the gable region is folded, bent, or both for the first time in step c).

9. The method for producing packaging according to claim 6, wherein the ears are heated before step e).

10. The method for producing packaging according to claim 6, wherein the ears are heated before step d).

11. The method for producing packaging according to claim 6, wherein after step f) the packaging is aseptically rinsed from the inside.

12. The method for producing packaging according to claim 6, wherein after step f) the packaging is firstly filled through an open base region and then the base region is closed.

13. The method for producing packaging according to claim 6, wherein after step f) firstly a base region of the packaging is closed and then the packaging is filled through the open pouring element.

14. The method for producing packaging according to claim 6, wherein the sleeve is held in the intermediate position on the mandrel using at least one spring clip.

* * * * *